United States Patent [19]

Deutsch

[11] 4,390,227

[45] Jun. 28, 1983

[54] CORD GRIP FOR ELECTRICAL WIRING CONNECTOR DEVICES

[75] Inventor: Peter C. Deutsch, Novato, Calif.

[73] Assignee: Marine Industries Company, Ignacio, Calif.

[21] Appl. No.: 214,254

[22] Filed: Dec. 8, 1980

[51] Int. Cl.[3] ..... H01R 13/58

[52] U.S. Cl. ..... 339/103 C

[58] Field of Search ..... 339/103, 105, 107

[56] References Cited

U.S. PATENT DOCUMENTS 3,989,340 11/1976 Sheldon et al. ..... 339/103 C

FOREIGN PATENT DOCUMENTS 1489532 4/1969 Fed. Rep. of Germany ... 339/103 C

*Primary Examiner*—Eugene F. Desmond

*Attorney, Agent, or Firm*—Owen, Wickersham & Erickson

[57] ABSTRACT

In an electrical connector, a cord grip assembly comprises cord gripping elements that are removably attached to the connector housing and spaced apart on opposite sides of an electrical cord extending into the housing. A cover means or end cap on the housing is moved axially as it is tightened to force the gripping elements tightly against the cord. Small projections on the outer sides of the gripping elements cooperate with internal notches of the end cap to maintain its tightened position and prevvent it from unwinding inadvertently.

8 Claims, 10 Drawing Figures

CORD GRIP FOR ELECTRICAL WIRING CONNECTOR DEVICES

BACKGROUND OF THE INVENTION

This invention relates to connector and coupling assemblies for electrical cord or cable and more particularly to an improved electrical cord or cable gripping device for use in combination with such assemblies.

In electrical plug wiring devices or coupling or receptacle assemblies wherein a cord or cable comprised of one or more wire conductors is connected to coupling terminals, it is necessary to secure the cord to the assembly so that external tension on the cord will not transmit stress to the internal wire connections. An early attempt to solve this cord gripping problem comprised the use of curved metal plates connected together and to the coupling housing. Such devices were particularly slow and tedious to assemble. Subsequently, a cord gripping device was developed using finger elements formed integrally with the receptacle housing to grip the cord, as shown in U.S. Pat. No. 3,437,980. One disadvantage with the aforesaid patented device was that the tooling for holding the integral finger elements was extremely complex and hence expensive. Another problem arose in the use of the prior art finger elements from the fact that they were drawn into their gripping position by screws connected to an end cap. Often, the screws were not installed to a uniform depth in the end cap and this caused the finger elements to apply unequal loading on the cord and the end cap to be cocked relative to the coupling body.

It is therefore a general object of the present invention to provide an improved cord gripping device for electrical wire devices, such as couplings, that solves the problems and overcomes the disadvantages of prior art devices.

Another object of the present invention is to provide an improved coupling with non-integral detachable gripping fingers that produce a highly effective gripping force on the cord when installed.

Yet another object of the invention is to provide an improved electrical coupling with detachable fingers for gripping the cord attached thereto when engaged by a rotatable end cap and which cooperates with the end cap to prevent it from rotating backwards after being installed.

Another object of the invention is to provide an electrical coupling with a cord gripping device that can be easily connected to an electrical cable without the need for highly skilled labor or special tools.

Another object of the invention is to provide an improved cord gripping coupling assembly, and one that is particularly well adapted for eased and economy of manufacture.

BRIEF SUMMARY OF THE INVENTION

An electrical coupling embodying the features of the invention has both male and female sections, each of which has a base plug member, an intermediate or housing member, and a protective end cap. The base plug member retains the conductive metal contacts with their respective terminals to which the wire leads of the cable or cord are connected in the well known manner. The intermediate housing surrounds the base plug member and encloses the power conducting cable leads extending to its terminals. In accordance with the invention, this housing has a pair of diametrically spaced apart slit-like openings adapted to receive and retain the ends of a pair of flexible cord gripping fingers. These fingers are separate elements preferably made from a tough but resiliently flexible plastic. They are easily inserted into and are retained by the slit-like housing openings, and they are readily removable and replaceable if necessary. When the leads of an electrical cable are attached to the base plug member, the fingers are cammed into their gripping position on the cord by the end cap which is threaded to the housing. A projection on the backside of each finger cooperates with notches on the inside of the end cap to prevent the cap from unwinding inadvertently after initial assembly and installation of the coupling.

Other objects, advantages and features of the invention will become apparent from the following detailed description of one preferred embodiment presented in conjunction with the accompanying drawing.

FIG. *7a* is a side view in elevation of a single cord gripping finger member before being inserted in a coupling housing;

FIG. *7b* is a view of the outer side of the finger member;

FIG. *7c* is a view of the inner side of the finger and member; and

Figure 1:
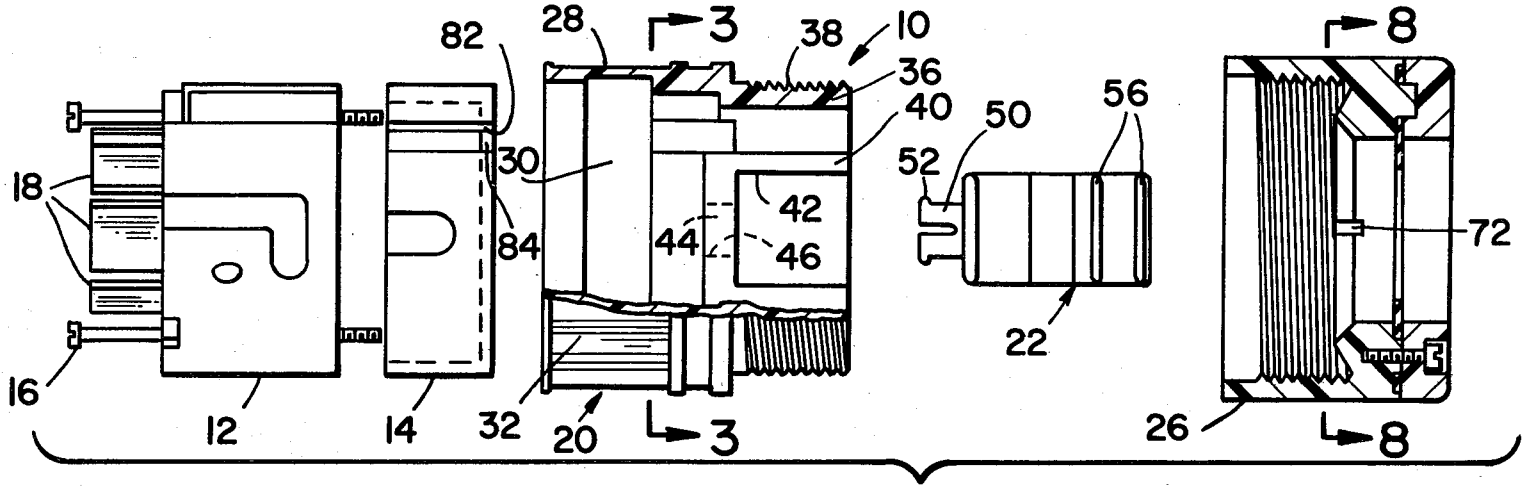
FIG. 1 is an exploded view in elevation and in section of a wiring device embodying features of the present invention.
Figure 8:
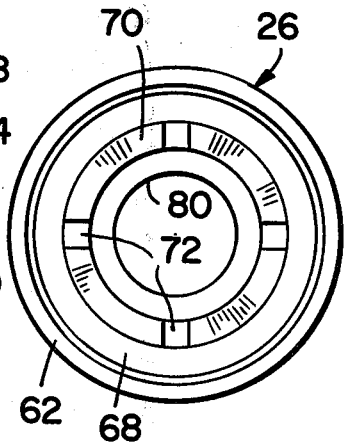

FIG. 8 is a view of the end cap taken along line 8—8 of FIG. 1.

DETAILED DESCRIPTION OF EMBODIMENT

With reference to the drawing, FIG. 1 shows an exploded view of an electrical wiring device 10 embodying the principles of the present invention which, for illustrative purposes, is a male plug assembly of an electrical coupling. In general, the device comprises an outer plug member 12 and an inner plug member 14, both of which are molded from a suitable plastic material and connected axially by a pair of screws 16. Within these plug members are terminals and connected conductive prongs 18 forming the male receptacle components of the device. The form and shape of these conductive prongs and terminals, as well as a grounding band (not shown), can be of any suitable design as well known in the art and such design is not critical to the invention. Also, although only the male plug assembly of a coupling is shown, the present invention, which relates to the cord holding feature, is equally applicable to the female plug assembly of the coupling that is not illustrated.

The inner and outer plug members 12 and 14, when connected together, are adapted to fit within a main housing 20 which is also preferably made from a plastic material.

Within one end of the housing is a pair of removable finger members 22 which, in accordance with one important aspect of the invention, functions to grip tightly a standard electrical cord 24 extending into the housing as the finger members are engaged by a rotatable end cap 26 threaded to the housing.

The housing is generally tubular and has a circular wall 28 at one end forming a cylindrical cavity 30 for receiving the connnected plug members. The outer surface of the wall 32 has an irregular contour, such as a plurality of grooves, to enable it to be easily gripped for turning. Within the cavity is a pair of integral bosses 34 located on opposite sides of the housing interior, and these are tapped to receive the screws 16 that extend through the plug members, thereby holding the plug members firmly in place within the housing.

Figure 5:
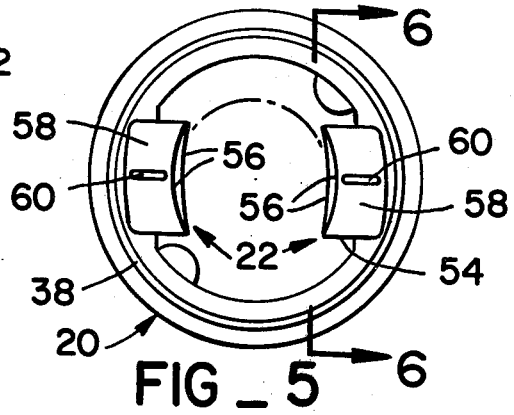
FIG. 5 is a view in section taken at line 5—5 of FIG. 4.
Figure 7A:
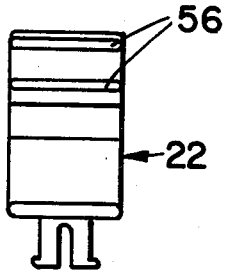
Figure 7B:
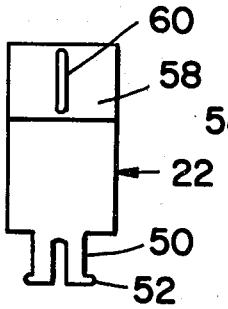
Figure 7C:
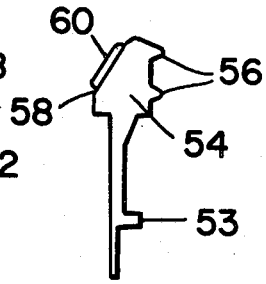
Figure 4:
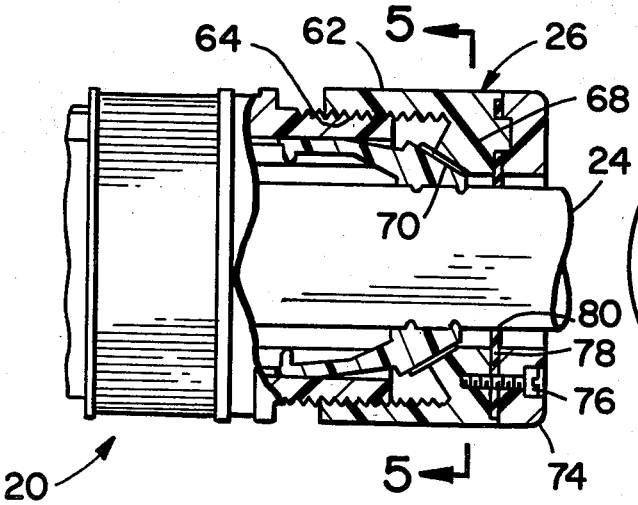
FIG. 4 is a view in elevation similar to FIG. 2, but partially in section, showing internal finger members gripping the attached cord.

At its other end, the housing has a circular wall 36 with reduced diameter and a series of external threads 38. On opposite interior sides of the housing wall 36 is a pair of thickened side wall portions 40. Each of these internal thickened wall portions has a rectangular shaped recess 42 that is open at one end flush with the threaded end opening of the housing wall 36. (See FIGS. 4 and 5). At the inner end of each recess is a transverse wall portion 44 having an open slot 46 centered therein. Each of these slots is perpendicular to a line extending diametrically across the housing through its axial centerline.

Each rectangular shaped recess 42 with its wall portion 44 and slot 46, forms a seat with a retaining means for a separate, detachable cord gripping finger member 22. As shown in FIGS. *7a–7c*, each finger, which is preferably molded from a suitable plastic as an integral component, has a flexible body portion 48 with substantially the same, but slightly smaller length and width dimensions. Extending from its inner end is a pair of closely spaced apart tines 50 having a thickness only slightly less than the open slots 46 in the wall portion 44 of the housing. At the ends of each tine is a small integral projection 52 that extends outwardly at generally a right angle to its length dimension. The width and spacing of the tines are such that when pressed together slightly they can readily be inserted through a slot 46, and when the projections 52 clear the inside of the slot, the tines spread apart so that the projections grip the rear surface of the wall portion 44. Near the inner ends of the tines is a transverse projection 53 that serves as a stabilizing bar that engages the inner surface of the recess wall portion 44 and helps to hold the finger firmly in place.

At the outer end of the flexible body of each finger 22 is an enlarged portion 54 that provides a cord gripping jaw means. On the inside of each enlarged finger portion is a pair of narrow, transverse projections 56 that form cord gripping teeth. The outermost projection has an arcuate shape, as shown in FIG. *7d*, and the inner projection is somewhat larger with less curvature. With this arrangement, both jaw projections engage and grip a cord with essentially equal contact force.

On the outside of each enlarged finger portion 54 is a beveled cam surface 58 having a preselected angle relative to the plane of the flexible body. Extending along the center line in a plane that also contains the longitudinal axis of the finger is a narrow, elongated raised boss or protrusion 60 whose function will be explained later.

Figure 2:
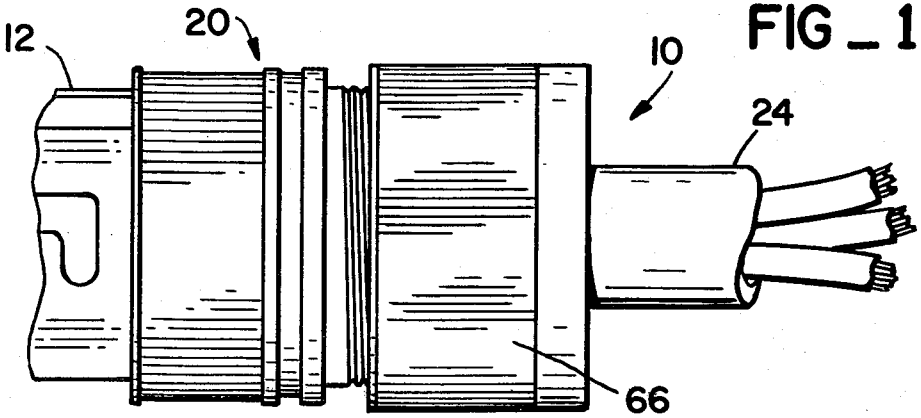
FIG. 2 is a view in side elevation of the wiring device of FIG. 1 when it is assembled and attached to a multilead electrical cord.
Figure 6:
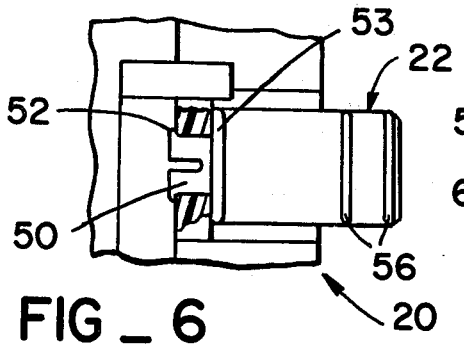
FIG. 6 is an enlarged fragmentary view taken along line 6—6 of FIG. 5.

The end cap 26 has a tubular body portion 62 with internal threads 64 extending inwardly from its open end and an outer non-slip surface of longitudinal grooves 66. (FIG. 2). At its outer end, the body portion is integral with an annular portion 68 having an internal conical surface 70 with substantially the same angle relative to the coupling center line as the cam surfaces 58 of the two fingers 22 when they are installed in the housing 20. Equally spaced apart circumferentially on the internal conical surface 70 are four radially extending notch-like depressions 72 which are slightly larger than the elongated protrusions 60 on the cam surface of each finger.

Figure 3:
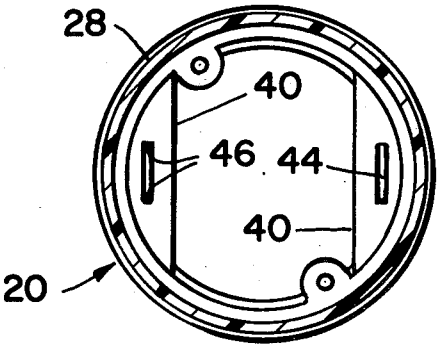
FIG. 3 is a view in section taken along line 3—3 of FIG. 1.

On the outer end of the end cap is a removable end ring 74 held to the annular portion of the tubular body portion 62 by a plurality of spaced apart screws 76. Between the annular portion 68 and the end ring is a thin, elastomeric, annular membrane 78 with a central opening 80 that serves as a moisture seal around the cord 24 that extends through the end cap, as shown in FIG. 3.

The connection of a multi-wire electrical cord to a coupling 10 can be accomplished quickly and easily without the need for extra skill or special tools. With the device disassembled, the finger members 22 are first inserted into their proper position within the housing, each finger being seated within its rectangular recess 42 with its tines 50 inserted through a slot 46 as previously described. The cord to be attached is now pushed through the opening 78 of the membrane 78 in the end cap and the wires of the cord are separated. The separated wires are pushed through spaced apart openings 82 of a transverse wall 84 of the inner plug member 14 adapted to extend within the cavity 30 at the smaller end portion of the housing. The wires are thus connected to the terminals of the inner plug member 12. After the wires are attached, the plug members are connected and inserted into the cavity of the housing and the end cap 26 is then threadedly attached to its other end. As the end cap is turned, its internal conical surface 70 bears against the cam surfaces 58 of the two cord gripping fingers 22. The bodies 48 of both fingers gradually flex until their jaw projections 56 engage the sides of the cord and grip it tightly. As the end cap is turned and tightened, the protrusions 60 on the cam surfaces of the fingers ratchet in the spaced apart depressions 72 on the internal conical surface 70 of the end cap. Thus, when the end cap is fully tightened, it is essentially locked in that position and will not become loose and unwind from the body. This assures the safety and structural integrity of the device over a long period of use. Moreover, with the firm grip of the finger jaws on the cord, any tension on the cord cannot affect the internal wire connections on the terminals within the device.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A cord grip assembly for an electrical wiring device, said assembly comprising:

a housing member having an opening therein for receiving an electrical cord;

a plurality of separate, flexible finger elements, each being removably secured to said housing member about said opening and extending generally parallel to its longitudinal axis, each said element having an inner end portion with means for latching it in said housing member and an outer end portion for engaging said cord;

end cover means for engaging said housing member having an opening for receiving said cord;

internal means in said cover means forming a shoulder effective to engage said finger elements and to force them together inwardly to grip said cord when said cover means is moved relative to said housing member.

2. The cord grip assembly as described in claim 1 wherein said housing member has a generally tubular shape with thickened inner portions, each having a narrow slot for receiving an inner end portion of a flexible finger.

3. The cord grip assembly as described in claim 2 including a recess in each said thickened inner portion for accommodating a substantial body portion of each said finger that extends beyond said narrow slot when attached to the housing member.

4. A cord grip assembly for an electrical wiring device, said assembly comprising:

a generally tubular housing member having an opening therein for receiving an electrical cord and a plurality of thickened inner portions, each with a slot;

a plurality of flexible finger elements removably attached to said housing member about said opening and extending generally parallel to its longitudinal axis, each said finger element having an elongated, relatively thin body portion with a plurality of spaced apart tines extending from one end thereof that fit into a said slot of said housing member, and an enlarged, thickened jaw portion at the other end of said body portion for engaging said cord;

end cover means for engaging said housing member having an opening for receiving said cord;

internal means in said cover means forming a shoulder effective to engage said finger elements and to force them together inwardly to grip said cord when said cover means is moved relative to said housing member.

5. The cord grip assembly as described in claim 4 wherein said jaw portion on each said finger element has spaced apart transverse teeth portions on an inner side for engaging the cord and a beveled surface on its outer side adapted for engagement by said end cover means.

6. The cord grip assembly as described in claim 5 wherein each said finger element has a protrusion on said beveled surface of its jaw portion, and said internal means in said cover means comprises a plurality of spaced apart recesses on the surface of said shoulder of said end cover means for receiving said protrusions as said cover means is tightened on said housing member to prevent it from unwinding inadvertently.

7. The cord grip assembly as described in claim 6 wherein said housing member has two said thickened inner portions spaced apart diametrically on opposite inner sides of said housing member, a recess in each said thickened portion having a rectangular shape, and open at the end of said housing member that is attached to said end member and terminating at a wall at its other end in which is a said slot for said tines of a finger element, each said finger element being seated in a said recess with its enlarged jaw portions extending beyond the end of said housing member.

8. The cord grip assembly as described in claim 7 wherein two spaced apart tines of each said finger element extend parallel, and an outwardly extending portion at the tip end of each tine for locking it within a said slot.

* * * * *